US006573832B1

(12) United States Patent
Fugere-Ramirez

(10) Patent No.: US 6,573,832 B1
(45) Date of Patent: Jun. 3, 2003

(54) REMOTE CONTROL FINDER

(76) Inventor: Lyne Fugere-Ramirez, P.O. Box 7063, Ocean View, HI (US) 96737

( * ) Notice: Subject to any disclaimer, the term of this patent is extended or adjusted under 35 U.S.C. 154(b) by 378 days.

(21) Appl. No.: 09/716,379

(22) Filed: Nov. 21, 2000

(51) Int. Cl.[7] ..... G08B 1/08

(52) U.S. Cl. ..... 340/539; 340/825.69; 340/825.36; 348/734

(58) Field of Search ..... 340/539, 825.69, 340/825.72, 825.36, 825.49; 348/734

(56) References Cited

U.S. PATENT DOCUMENTS

| | | | | |
|---|---|---|---|---|
| 4,507,653 | A | 3/1985 | Bayer | 340/539 |
| 4,558,307 | A | 12/1985 | Lienart van Lidt | 340/527 |
| 5,598,143 | A | 1/1997 | Wentz | 340/539 |
| 5,629,677 | A | 5/1997 | Staino, Jr. | 340/568 |
| 5,638,050 | A | 6/1997 | Sacca et al. | 340/539 |
| 5,673,023 | A | 9/1997 | Smith | 340/539 |
| 5,677,673 | A | 10/1997 | Kipnis | 340/539 |
| 5,680,105 | A | 10/1997 | Hedrick | 340/539 |
| 5,689,238 | A | 11/1997 | Cannon, Jr. et al. | 340/568 |
| 5,939,981 | A | 8/1999 | Renney | 340/539 |

*Primary Examiner*—Donnie L. Crosland
(74) *Attorney, Agent, or Firm*—Richard C. Litman

(57) ABSTRACT

A remote control finder or locating device for finding lost personal items, such as keys, a television/VCR remote control, a pager, a cellular phone or eyeglasses. The remote finder sends a radio signal to a selected one of a plurality of button-shaped receivers that emits an audible beeping noise upon activation of the appropriate radio signal. The receiver attaches to the back of any personal item by a sticker. The remote control transmitter has individually numbered buttons which correspond to the item the user wishes to locate. The remote control transmitter fits into a wall-mounted bracket when not in use. In case the remote control transmitter, itself, is lost, a button located on the mounting bracket sends out a signal which activates the remote control transmitter to emit a beeping sound and so assists in locating the finder.

5 Claims, 4 Drawing Sheets

REMOTE CONTROL FINDER

BACKGROUND OF THE INVENTION

1. Field of the Invention

The present invention relates to locating devices. More particularly, the present invention relates to locating devices for finding misplaced or lost keys, remote controls, wallets, etc.

2. Description of the Related Art

The loss of personal items, such as keys, glasses, remote controls, wallets and even the loss of children or pets, is a constant source of frustration and even danger in an emergency situation. Various schemes have been devised for locating objects, etc. which demonstrate limited success by their very design.

U.S. Pat. No. 4,507,653, issued on Mar. 26, 1985, to Bayer, describes an object finder device which can be mounted on a personal item and responds by an audible signal to a predetermined sound such as hand clapping, whistling, and the like. The effectiveness of this device would necessarily be limited to the range where the designated sound reaches a threshold level.

U.S. Pat. No. 4,558,307, issued Dec. 10, 1985, to Lienart van Lidt de Jeude, describes a light actuated reminder device for attachment to keys, a wallet or a diary, and the like which would normally be left in a pocket or cabinet where light stimulation is absent. Upon exposure to light for a predetermined time, an alarm within the device sounds. A cover is provided for placement over the device sensor when not in operation. This system is impractical in that a cover could be easily lost. Also, the item could be left at a location with the cover on and then the location for the item could be easily forgotten, resulting in inoperativeness of the system and loss of the item.

U.S. Pat. No. 5,598,143, issued on Jan. 28, 1997, to Wentz, describes a device for mounting in a location, such as near a television, which selectively signals a plurality of control devices known as beepers upon actuation so as to activate a sound signal from each selected control device so as to disclose their location. This system does not provide for the location of personal items, etc. but only to hand-held remote control devices.

U.S. Pat. No. 5,629,677, issued on May 13, 1997, to Staino, Jr. describes a locator system particularly designed for eyeglasses. The eyeglass holder acts as the finding device and signals are transmitted from the holder to a device on the eyeglasses which emits an audible signal upon manual activation of the combination holder and finding device. This system is practically confined to eyeglasses and is not appropriate for use with other personal items which are subject to loss.

U.S. Pat. No. 5,638,051, issued on Jun. 10, 1997, to Sacca et al., describes a finding device primarily used for the location of a remote control useful in controlling a television. The primary novelty apparent in this description is reduced power consumption of the receiver which activates an audible signaling device. This system is not amenable to finding a variety of discreet personal items. The finder is also subject to being mislaid, thus prejudicing the reliability of the locator system.

U.S. Pat. No. 5,673,023, issued Sep. 30, 1997, to Smith, describes a locating system primarily designed for locating remote control units for television, etc. which employs both light signaling and simulated speech sound signaling at the receiver portion which is located on one or the respective remote control units. This system would not be practical for finding small objects such as keys or wallets, etc.

U.S. Pat. No. 5,677,673, issued Oct. 14, 1997, to Kipnis describes a wall-mounted personal item locator unit which has a plurality of labeled buttons which correspond to receiver units mountable on objects subject to loss. Each mountable receiver unit emits a characteristic sound such that upon activation of the item locator unit, the desired object may be found by listening for its sound emission. An alternative system employs a transportable transmitter unit. The transmitter continually transmits an activation signal intermittently upon actuation. The selected receiver unit then sends out a signal back to the transmitter activating a flashing light such as a light-emitting diode (LED). As the user approaches the lost item, the rate of flashing increases. This light emitting mode is used in addition to the sound emitting device on the receiver. This system is of limited usefulness in the wall-mounted embodiment due to necessarily limited range. In the case of the portable locator, the locating device is itself subject to loss, thus compromising the system overall reliability.

U.S. Pat. No. 5,680,105, issued Oct. 21, 1997, to Hedric describes a locating device for locating household objects by means of matching coded senders and receivers mounted on a rack when not in use. The elements for attachment are coded to respond to a multiplicity of corresponding individual finders. This system suffers from a design having a large number of parts which are subject to loss. The cost of having individual finders with separate circuits results in an unduly expensive locator system. The elements for attachment are relatively large and would not be appropriate for small objects such as key chains and the system would necessarily be limited in range due to the small size of the finders.

U.S. Pat. No. 5,689,238, issued on Nov. 18, 1997, to Cannon, Jr. et al. describes an object locator system particularly adapted to finding marked documents in a random file in a file cabinet. Means are disclosed for providing the file with either a sound emitting device which is interrogated by a coded finder, or a homing device which responds to a particular coded electronic signal sending device with an audible output which increases in loudness upon approaching the desired file. This system is subject to loss or misplacement of the locator device and the disclosure is restricted to a filing system environment.

U.S. Pat. No. 5,939,981, issued on Aug. 17, 1999 to Renney describes an item locator with attachable receiver/transmitter. There is no provision, however, for locating the item locator if it should be misplaced.

None of the above inventions and patents, taken either singularly or in combination, is seen to describe the instant invention as claimed. Thus, a remote control finder solving the aforementioned problems is desired.

SUMMARY OF THE INVENTION

The present invention relates, generally, to locating devices, and more specifically, the invention is a locating device for finding lost personal items, such as keys, a television/VCR remote control, a pager, a cellular phone or wallet, etc. The remote finder sends a radio signal to a selected one of a plurality of button-shaped receivers that emits an audible beeping noise upon activation by the appropriate radio signal. The receiver attaches to the back of any personal item by a sticker such as adhesive-VELCRO.

The remote control transmitter has individually numbered buttons which correspond to the item the user wishes to locate. The remote control transmitter fits into a wall-mounted bracket when not in use. In case the remote control transmitter, itself, is lost, a button located on the mounting bracket sends out a signal which activates the remote control transmitter to emit a beeping sound and so assists in locating the finder.

Accordingly, it is a principal object of the invention to provide a finding device which is capable of allowing the user to find lost or mislaid personal items, such as keys, eyeglasses, and the like.

It is another object of the invention to provide a finding device as above which is mountable for easy removal in a wall-mounted bracket.

It is a further object of the invention to provide a finding device as above in which a button-actuated radio sender is located upon said bracket and a corresponding radio receiver is located in the remote finding device which activates an audible beeper sound so as to assist a user in finding the finder when mislaid or lost.

Still another object of the invention is to provide a finding device as above wherein each of the button shaped receivers is attached at the center of a round adhesive-VELCRO patch, the outer circumference of the patch being available to attach the receiver to the personal item subject to loss.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is a locating device for finding lost personal items, such as keys, a television/VCR remote control, a pager, a cellular phone or wallet, etc. The remote finder sends a radio signal to a selected one of a plurality of button-shaped receivers that emits an audible beeping noise upon activation by the appropriate radio signal. The receiver attaches to the back of any personal item by a sticker. The remote control transmitter has individually numbered buttons which correspond to the item the user wishes to locate. The remote control transmitter fits into a wall-mounted bracket when not in use. In case the remote control transmitter, itself, is lost, a button located on the mounting bracket sends out a signal which activates the remote control transmitter to emit a beeping sound and so assists in locating the finder.

Figure 1:
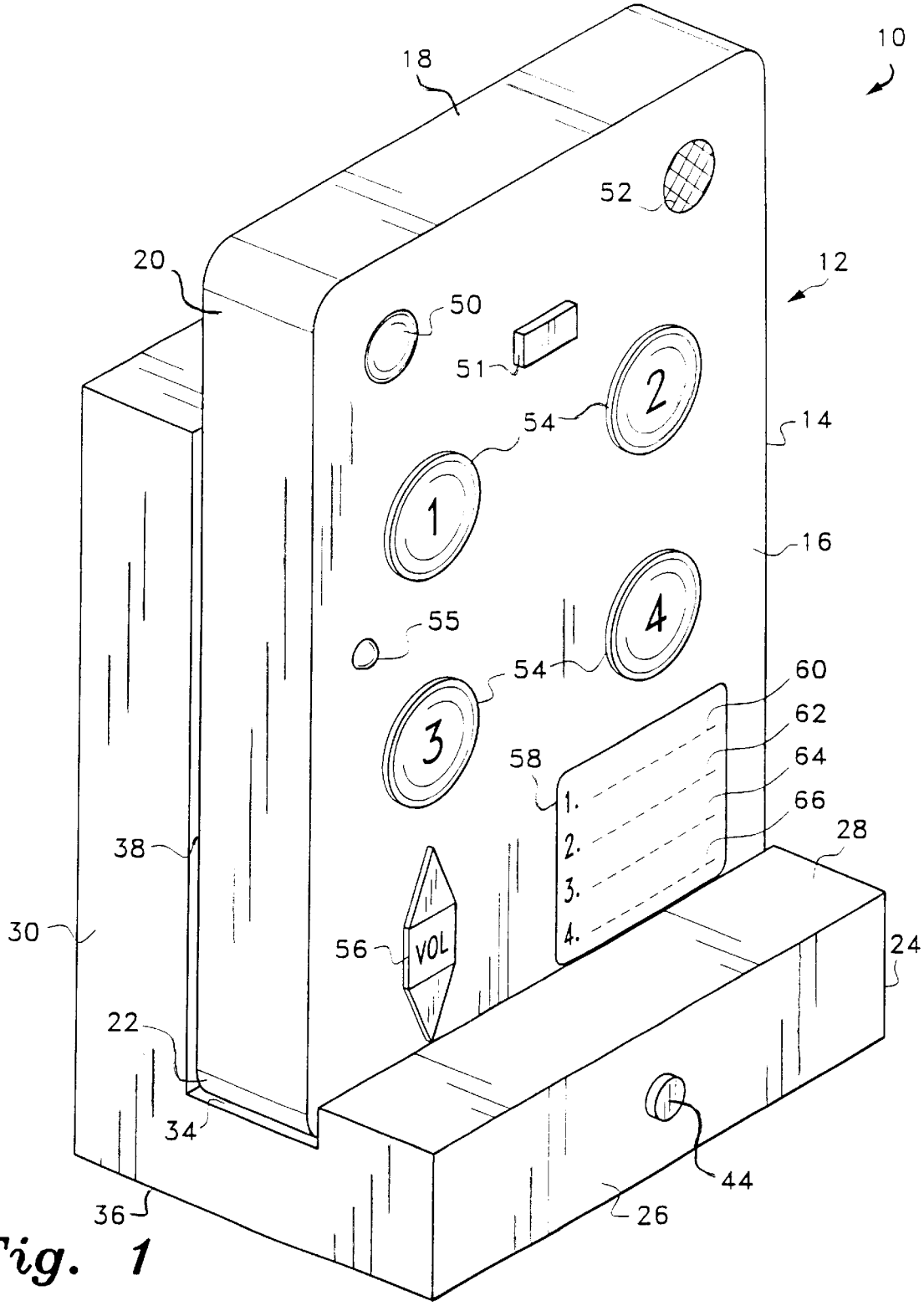
FIG. 1 is an environmental, perspective view of a remote control finder as mounted in its wall-mounted bracket according to the present invention.
Figure 2:
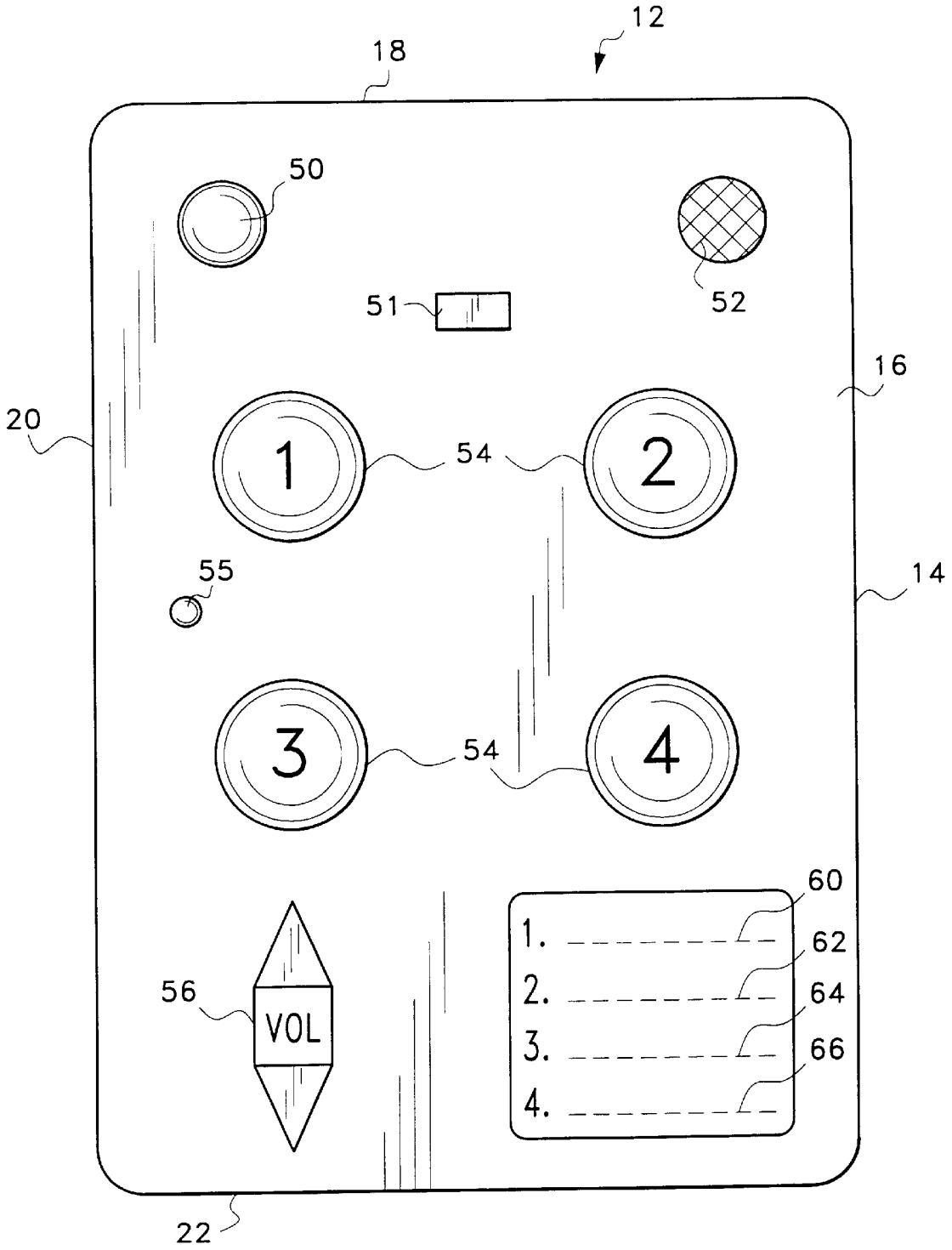
FIG. 2 is a front view of the remote control finder of FIG. 1.

Referring to FIG. 1 there is shown an environmental perspective view of the finder resting in its finder bracket, and in FIG. 2, an elevation view of the front of the finder, wherein finder system 10 includes portable finder 12 having first sidewall 14, front wall 16, upper wall 18, second sidewall 20, and lower wall 22. Finder 12 is storable in finder bracket 24. Bracket 24 includes back wall 30, shelf 36 projecting forward from the base of back wall 30, and front wall 26 forming a lip 28 which defines a notch 34 for receiving the finder 12. Portable finder 12 is placed in the notch 34 with finder back wall 38 resting against back wall 30. Bracket back wall 30 may have mounting means such as grooves for screw heads for mounting the finder bracket 24. Bracket finder radio signal transmitter activation button 44 is located on bracket front wall 26.

Portable finder 12 features finder on-off switch 50, finder LED (light emitting diode) flashing light 51, finder beeper speaker 52, finder receiver activator buttons 54, finder low-battery indicator light 55, finder beeper volume control 56, and finder button identifier list 58. Identifier list 58 features finder first list member 60, finder second list member 62, finder third list member 64, and finder fourth list member 66, corresponding to indicia numbers on finder receiver activator buttons 54, respectively.

Figure 3:
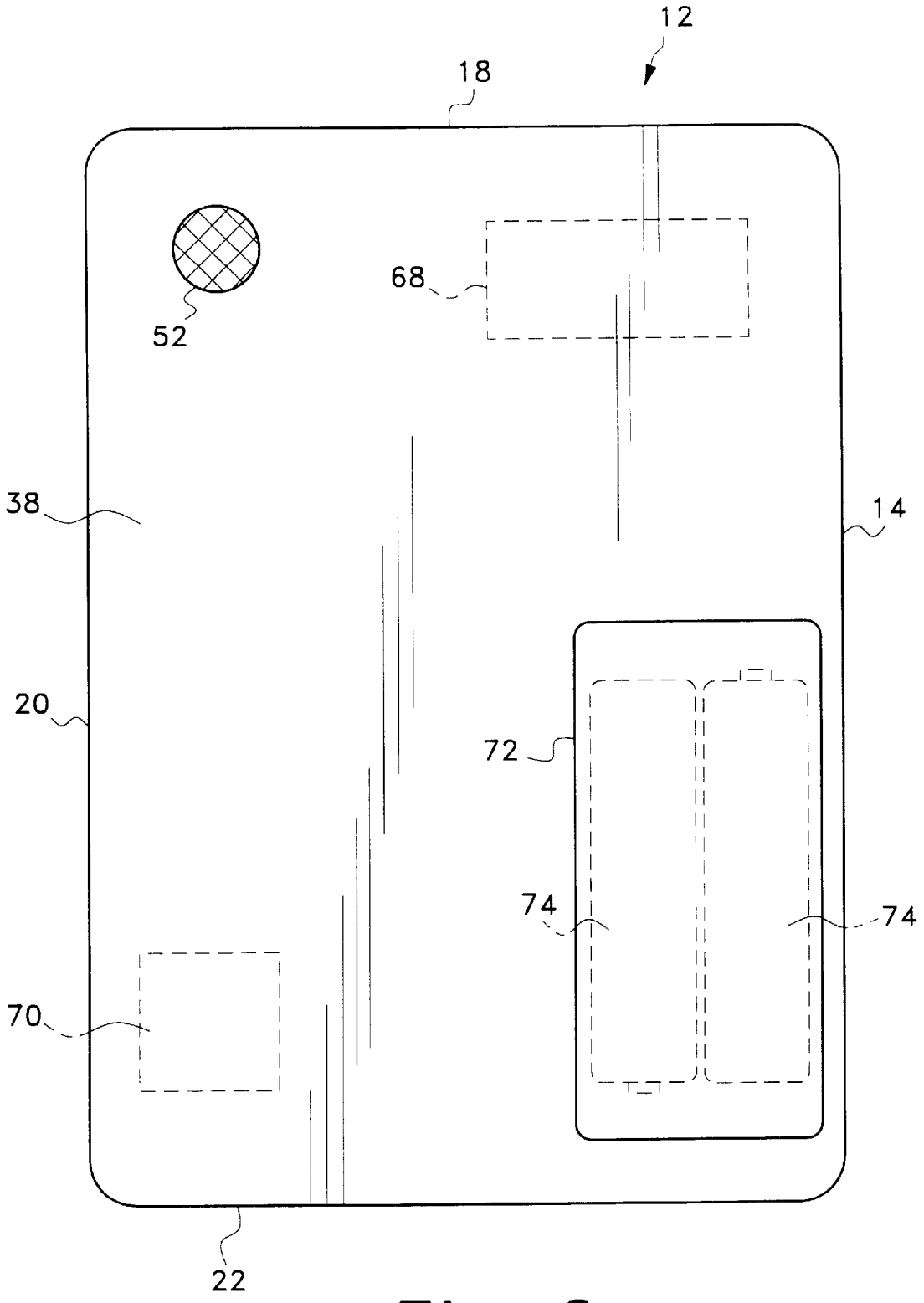
FIG. 3 is a back view of the remote control finder of FIG. 1

Referring to FIG. 3, there is shown a back elevation view of portable finder 12 having first sidewall 14, upper wall 18, second sidewall 20 and lower wall 22. Further shown on the finder back wall 38 is finder beeper speaker 52. Microchip 68 and radio receiver/transmitter 70 are internally mounted within portable finder 12. Battery recess 72, has finder electric supply batteries 74 mounted between electrodes(not shown). Batteries 74 within recess 72 are covered for access in a conventional manner, such as a removable battery compartment wall.

Figure 4:
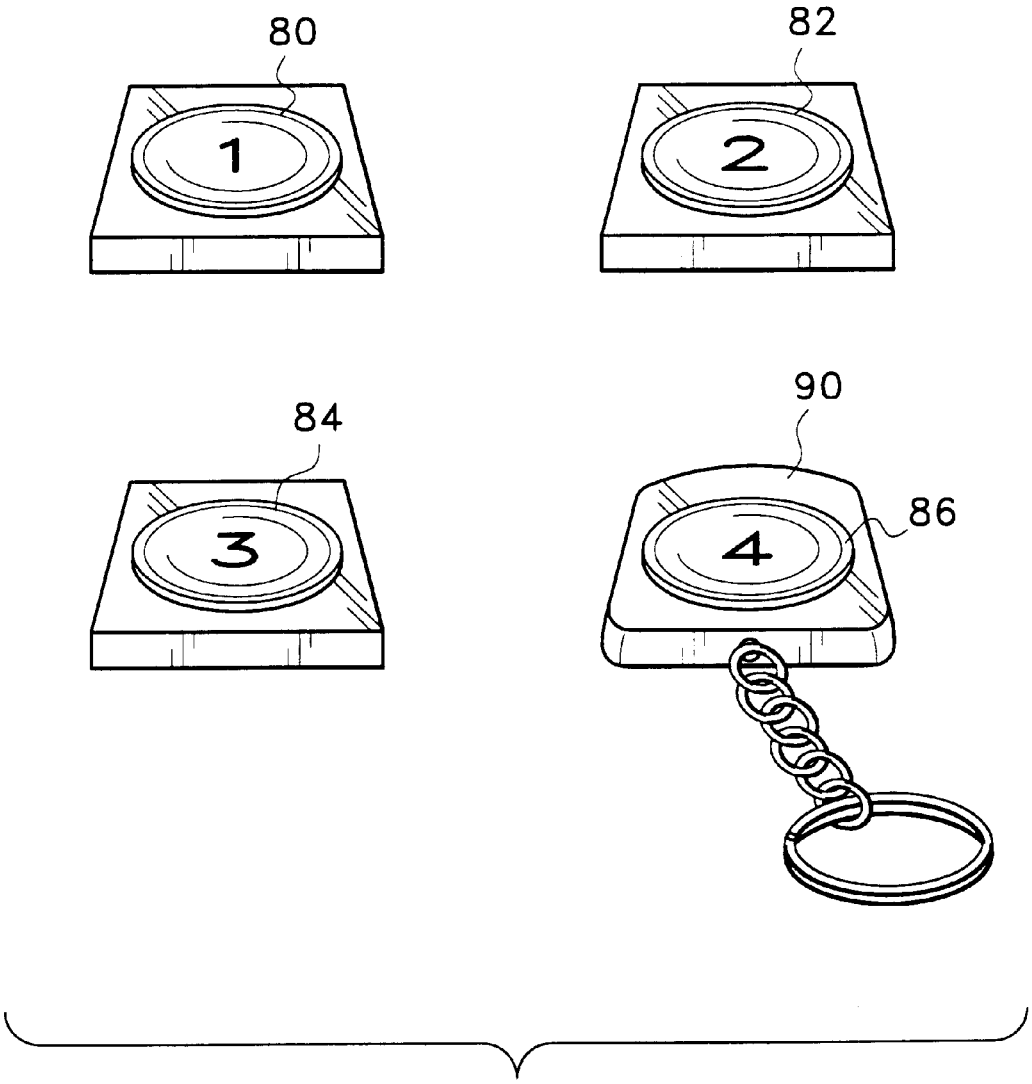
FIG. 4 is perspective view of the receiver/beeper devices to be mounted on personal items to be found.

Referring to FIG. 4, there is shown an array of receiver beepers including first receiver-beeper disk 80, for reception of a first particular radio transmitter signal corresponding to finder first list member 60, second receiver-beeper disk 82, for reception of a second particular radio transmitter signal corresponding to finder second list member 62, third receiver-beeper disk 84, for reception of a third particular radio transmitter signal corresponding to finder third list member 64, and fourth receiver-beeper disk 86 for reception of a fourth particular radio transmitter signal corresponding to finder fourth list member 64. Receiver-beeper disk 86 is shown mounted in the fob of key ring set 90.

Receiver-beeper disks 80–86 are small, disk-shaped items, each having a miniature battery, microchip, printed circuit board, and radio receiver-transmitter, acting as a beeper actuator for a beeper speaker, and exhibiting respective indicia corresponding to that on buttons 54 of the finder 12, the common names of which are listed on finder button identifier list 58. They emit an audible beeper sound which increases in volume as the portable finder 12 approaches their location. They are individually attachable to personal items subject to loss by any appropriate means such as by glue or an adhesive-VELCRO located on the back of receiver-beeper disks 80–86. It is recognized that the details of the circuitry for the radio transmitters, receivers, beepers, and actuation buttons are known in the prior art and are not part of the present invention.

In operation, receiver-beeper disks 80–86 are mounted on individual items needing protection from loss. The respective indicia of the disks are written on identifier list 58, which indicia also correspond to respective indicia on each of finder activator buttons 54. When one of the protected items, such as a wallet or cell phone is mislaid, the user removes finder 12 from finder bracket 24. He then consults the finder button identifier list 58 for the indicia corresponding to that item (in this case wallet) and then pushes the button 54 bearing that indicia. Finder 12 then emits a particular radio signal actuated by the pressing of that button. The receiver-beeper disk having the corresponding indicia to the button detects this radio transmitter signal and is then actuated to produce an audible beeping sound, leading the user to the item. The audible beeping sound increases in intensity as the portable finder approaches its location. It is noted that separate discreet signals are emitted by the finder for each finder activator button and no other receiver-beeper disk will respond to that signal.

If an item is covered with sofa pillows and the beeper sound is inaudible, the LED light 51 is useful in finding the item. The LED light 51 on the portable finder front wall 16 flashes intermittently upon activation of a receiver-beeper disk, the flashing interval decreasing as the portable finder 12 approaches the activated receiver-beeper disk, i.e., the rate a flashing of LED light 51 increases upon said approach.

It is also contemplated that the portable finder of the invention may be mislaid. In such a situation, the wall mounted finder bracket 24 is actuated by the user by pushing bracket finder radio signal transmitter activation button 44. The finder contains a radio receiver(not shown) which, upon detecting a discreet radio signal emanating from the finder bracket, activates the finder beeper speaker 52. The user may then easily find the mislaid finder by listening for the audible beeps emanating from the remote finder. It is easily recognized that any desired number of buttons and corresponding receiver-beepers may be incorporated in the invention for locating a corresponding number of items.

It is to be understood that the present invention is not limited to the embodiment described above, but encompasses any and all embodiments within the scope of the following claims.

I claim:

1. A remote control finder comprising:

a) a plurality of receiver units, each comprising:
   1) a disk-shaped receiver housing having a first adhesive fastener means on the back side, thereof, for attachment to an object to be found;
   2) indicia indicative of said object located on a top surface of said receiver housing;
   3) a speaker situated within said receiver housing for transmitting an audio signal; and
   4) a receiver situated within the receiver housing and connected to said speaker, the receiver mechanism of each said receiver units adapted to transmit an audio signal via said speaker thereof upon the receipt of a particular activation signal;

b) a finder transmitter unit comprising:
   1) a transmitter housing with generally rectangular configuration having a front face, a rear face, and periphery formed therebetween, having first and second sidewalls, a top wall, and a bottom wall defining an interior space;
   2) a plurality of push button switches situated centrally on the front face of the housing in an array pattern;
   3) a finder button identification list located on the lower portion of said housing front face,
   4) a plurality of locations on said list, each location corresponding to one of said plurality of push buttons switches;
   5) corresponding indicia located at each of said plurality of locations and said push button switches so as to effect identification of said corresponding push button switch; and
   6) a transmitter means situated within said finder transmitter housing and coupled to said push button selection switches, said transmitter means being adapted to transmit a unique activation signal corresponding to one of said receiver units upon the depression of a corresponding push button switch, whereby one of said receiver units transmits an audio signal;
   7) said finder transmitter housing having a radio receiver means therein, and connected to speaker means mounted on the face of said finder transmitter so that upon activation of said finder radio receiver means said finder speaker means, emits an audible signal; and c) a bracket for fixed location on a wall, the bracket physically receiving said finder transmitter unit for storage when not in use, the bracket having a push button switch located upon a front face thereof, and a radio transmitter located within said bracket, wherein said bracket push button switch activates said finder transmitter speaker to emit said audible signal so as to enable a user to locate said finder transmitter if it is misplaced.

2. The remote control finder of claim 1, further comprising a sound control switch located on the face of said transmitter receiver operative to raise and lower the audible sound produced by said transmitter receiver speaker.

3. The remote control finder of claim 1, further comprising an on-off switch located on the face of said finder for activating or deactivating the finder.

4. The remote control finder of claim 1, further comprising an LED light located on the face of said finder which starts flashing upon activation of one of said receiver units, wherein the flashing rate thereof increases as said remote control finder approaches said activated receiver unit.

5. The remote control finder of claim 1, further comprising a low battery light indicator located on the face of said finder.

* * * * *